US010118060B2

(12) United States Patent
Owens et al.

(10) Patent No.: US 10,118,060 B2
(45) Date of Patent: Nov. 6, 2018

(54) SELECT SCHIFF BASE COMPOUNDS FOR CHEMICAL AGENT DETOXIFICATION

(71) Applicant: The United States of America as Represented by the Secretary of the Air Force, Washington, DC (US)

(72) Inventors: Jeffery Ray Owens, Panama City, FL (US); Wallace Bruce Salter, Panama City, FL (US); Katherine Moss Simpson, Panama City, FL (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 166 days.

(21) Appl. No.: 14/029,952

(22) Filed: Sep. 18, 2013

(65) Prior Publication Data

US 2015/0079304 A1 Mar. 19, 2015

(51) Int. Cl.

| | |
|---|---|
| ***A62D 3/36*** | (2007.01) |
| ***D06M 13/272*** | (2006.01) |
| ***D06M 13/335*** | (2006.01) |
| ***D06M 13/352*** | (2006.01) |
| ***D06M 13/355*** | (2006.01) |
| ***D06M 16/00*** | (2006.01) |
| *A62D 101/02* | (2007.01) |
| *A62D 101/22* | (2007.01) |
| *A62D 101/26* | (2007.01) |
| *A62D 101/28* | (2007.01) |

(52) U.S. Cl.

CPC ..... *A62D 3/36* (2013.01); *D06M 13/272* (2013.01); *D06M 13/335* (2013.01); *D06M 13/352* (2013.01); *D06M 13/355* (2013.01); *D06M 16/00* (2013.01); *A62D 2101/02* (2013.01); *A62D 2101/22* (2013.01); *A62D 2101/26* (2013.01); *A62D 2101/28* (2013.01)

(58) Field of Classification Search

CPC ..... C07D 215/48; C07D 275/04; A62D 3/36; A62D 2101/02; A62D 2101/22; A62D 2101/26; A62D 2101/28; D06M 13/272; D06M 13/335; D06M 13/352; D06M 13/355; D06M 16/00

See application file for complete search history.

(56) References Cited

U.S. PATENT DOCUMENTS

| | | | |
|---|---|---|---|
| 3,482,927 | A | 12/1969 | O'Brien et al. |
| 5,554,664 | A | 9/1996 | Lamanna et al. |
| 6,852,903 | B1 | 2/2005 | Brown et al. |
| 2012/0135658 | A1 | 5/2012 | Stone et al. |

FOREIGN PATENT DOCUMENTS

| | | |
|---|---|---|
| CN | 101053689 | * 10/2007 |
| GB | 975982 | 11/1964 |
| JP | 2007247104 | 9/2007 |

OTHER PUBLICATIONS

Ashby, Toxicology, vol. 103, p. 177-194, 1995.*
Ashby, CA124:78944, abstract only of Toxicology, vol. 103, pp. 177-194, 1995.*
Belgova, CA50:2303, abstract only of Byulleten Eksperimental'noi Biologii i Meditsiny, 40(No. 7), 52-55, 1955.*
Chang, Physiologia Plantarum vol. 101, 471-476, 1997.*
Hess, Klinische Wochenschrift, vol. 19, 104-106, 1940.*
Hess, CA34:36660, abstract only of Klinische Wochenschrift, vol. 19, 104-106, 1940.*
Roberts, Ind Eng Chem Res, vol. 55, 1813-1818, 2016.*
The DOW Chemical Company, "BIOBAN CS-1135," Product Information Sheet, Form No. 253-01207 (2002) 8 pages total.
McGrath, J. E., et al., "Microwave processing of polymeric materials," Final Report for Contract No. WL-TR-92-4002 (1992) 286 pages total.
European Patent Office, International Search Report and Written Opinion in International Patent Application No. PCT/GB2014/052828, dated Jan. 21, 2015, 4 pages total.
J-PLAT-PAT, Translation of JP Application No. 2007-247104, filed Mar. 16, 2006, 8 pages total.
Patent Translate, CN 101053689, Oct. 2007, 16 pages total.
Google Translation of Erich Hesse, "Die Entgiftung Des Bleis," Klinische Wochenschrift, vol. 19 (1940) 104-106.
European Patent Office, Examiner communication in Application No. 14 772 427.2, dated Dec. 4, 2017, 5 pages total.

* cited by examiner

*Primary Examiner* — D Margaret M Seaman
(74) *Attorney, Agent, or Firm* — AFMCLO/JAZ; Chastity Whitaker

(57) ABSTRACT

A Schiff base compound configured to detoxify a toxic chemical agent. The toxic chemical agent includes at least one leaving group and the Schiff base compound includes an imine having at least one Lewis base and an alkyl substituent or an aryl substituent having an electron acceptor. The at least one Schiff base nitrogen is spaced way from the electron acceptor by a distance that ranges from about 200 pm to about 1000 pm.

8 Claims, 9 Drawing Sheets

SELECT SCHIFF BASE COMPOUNDS FOR CHEMICAL AGENT DETOXIFICATION

RIGHTS OF THE GOVERNMENT

The invention described herein may be manufactured and used by or for the Government of the United States for all governmental purposes without the payment of any royalty.

FIELD OF THE INVENTION

The present invention relates generally to treatments for substrates and, more particularly, to treatments of fabrics and textiles.

BACKGROUND OF THE INVENTION

Some materials, including, for example, garments, worn by first responders and soldiers are conventionally pretreated to protect the wearer from exposure to poisonous chemicals. The pretreatments can be applied to a wide variety of surfaces and substrates including, for example, coatings, textiles, plastics, metals, ceramics, and polymers. In operation, the treatments usually detoxify poisonous chemicals by oxidation or by preventing skin contact through repellant coatings and absorbents.

However, these conventional treatments often damage or degrade the surface or substrate on which it is applied. Alternatively, or additionally, the conventional treatments cause respiratory irritation and/or contact dermatitis in the wearer. Moreover, the conventional treatments are stoichiometric in nature—that is, each molecule of the conventional treatments neutralizes, decontaminates, or otherwise reacts with a particular number of molecules of the poisonous chemical. In some instances, the stoichiometry is one-to-one. Therefore, and over time, the treatment becomes less effective and may, in other words, wear out or be rendered completely ineffective.

Accordingly, there remains a need for substrate treatment chemicals by which a wide range of poisonous chemical agents can be neutralized so as to protect the wearer, while limiting damaging effects on the substrate or surface on which it is applied. Furthermore there is a need for pretreatment chemicals that are not respiratory irritants and/or dermatological irritants.

SUMMARY OF THE INVENTION

The present invention overcomes the foregoing problems and other shortcomings, drawbacks, and challenges of the conventional substrate treatment chemicals. While the invention will be described in connection with certain embodiments, it will be understood that the invention is not limited to these embodiments. To the contrary, this invention includes all alternatives, modifications, and equivalents as may be included within the spirit and scope of the present invention.

According to one embodiment of the present invention, a compound for detoxification of a toxic chemical agent having at least one leaving group. The compound includes an imine having at least one Schiff base nitrogen and an alkyl substituent or an aryl substituent having an electron acceptor. The at least one Schiff base nitrogen is spaced away from the electron acceptor by a distance that ranges from about 200 pm to about 1000 pm.

Another embodiment of the present invention is directed to a method of preparing a detoxifying substrate by selecting a compound for detoxifying a toxic chemical agent having at least one leaving group. The compound includes at least one Schiff base nitrogen that is separated from an alkyl substituent or an aryl substituent having an electron acceptor by a distance that ranges from about 200 pm to about 1000 pm. A quantity of the compound is applied to the substrate and, optionally, the substrate is dried.

Still another embodiment of the present invention is directed to a method of detoxifying a contaminated substrate contaminated by selecting a compound for detoxifying a toxic chemical agent having at least one leaving group. The compound includes at least one Schiff base nitrogen that is separated from an alkyl substituent or an aryl substituent having an electron acceptor by a distance that ranges from about 200 pm to about 1000 pm.

In accordance with yet another embodiment of the present invention, a catalyst for detoxifying a toxic chemical agent having at least one leaving group. The catalyst includes an imine having at least one Schiff base nitrogen and an alkyl substituent or an aryl substituent having an electron acceptor. The at least one Schiff base nitrogen is spaced way from the electron acceptor by a distance that ranges from about 200 pm to about 1000 pm. The Schiff base nitrogen is configured to undergo a nucleophilic attack on the chemical agent possessing the at least one leaving group, which detoxifies the toxic chemical agent.

Additional objects, advantages, and novel features of the invention will be set forth in part in the description which follows, and in part will become apparent to those skilled in the art upon examination of the following or may be leaned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and constitute a part of this specification, illustrate embodiments of the present invention and, together with a general description of the invention given above, and the detailed description of the embodiments given below, serve to explain the principles of the present invention.

It should be understood that the appended drawings are not necessarily to scale, presenting a somewhat simplified representation of various features illustrative of the basic principles of the invention. The specific design features of the sequence of operations as disclosed herein, including, for example, specific dimensions, orientations, locations, and shapes of various illustrated components, will be determined in part by the particular intended application and use environment. Certain features of the illustrated embodiments have been enlarged or distorted relative to others to facilitate visualization and clear understanding. In particular, thin features may be thickened, for example, for clarity or illustration.

DETAILED DESCRIPTION OF THE INVENTION

The present invention relates to compounds for chemical agent detoxification and methods of applying the compounds to substrates for detoxification thereof or treatment prior to exposure to the chemical agent.

As used herein, "alkyl" means a branched or unbranched, alkane or alkene substituent consisting of carbon and hydrogen, for example, methyl, ethyl, propyl, isopropyl, 1-butyl, 2-butyl, isobutyl, tert-butyl, pentyl, 2-methylbutyl, 1,1-dimethylpropyl, hexyl, heptyl, octyl, nonyl, and decyl.

As used herein, "aryl" means a cyclic, aromatic substituent consisting of hydrogen and carbon, for example, phenyl, naphthyl, and biphenylyl.

As used herein, "Schiff base nitrogen" is defined as the nitrogen atom of a carbon-nitrogen double bond, wherein the nitrogen atom is chemically bonded to the alkyl or aryl and not to a hydrogen atom.

As used herein, "substituted" is defined by the substitution of a hydrogen on a carbon by a univalent group including, but not limited to, halogen, hydroxy, thiol, amino, nitro, cyano, C1-C4 alkyl, alkylamino, carboxy, amido, vinyl, and C1-C5 alkoxy.

"Lewis acid," as used herein, is defined as a chemical substance that can employ an electron lone pair from another molecule.

"Lewis base," as used herein, is defined as any chemical substance that donates a pair of electrons to a Lewis acid.

"Tautomers," as used herein, are structural isomers of organic compounds that are in dynamic equilibrium due to the migration of a proton.

Figure 1B:
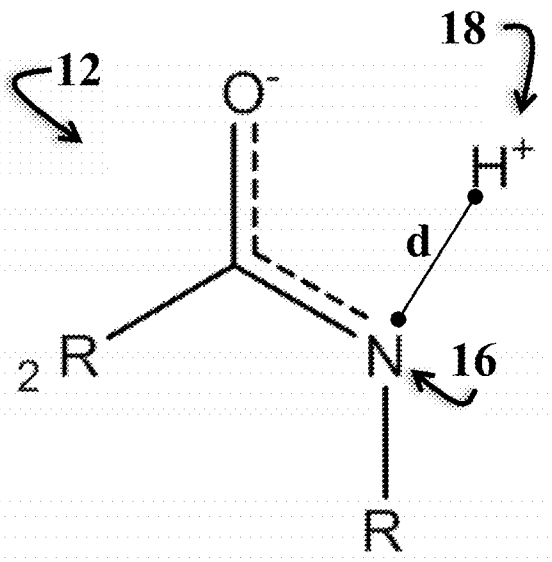
FIGS. 1A and 1B are representations of pretreatment chemicals according to embodiments of the present invention.
Figure 1A:
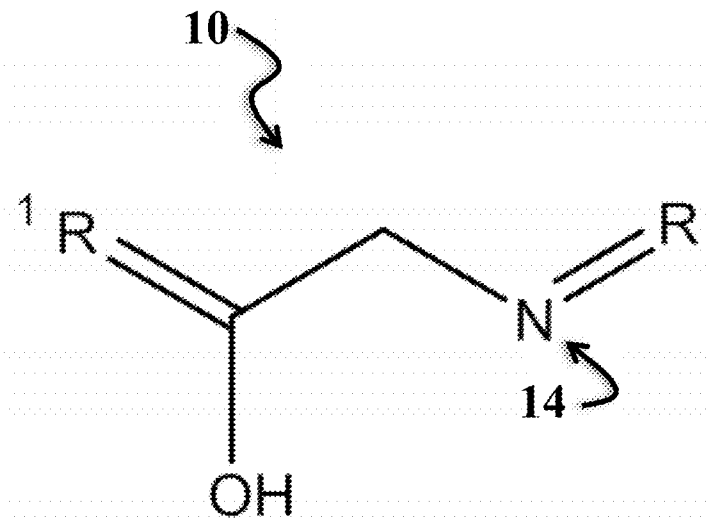

Referring now to the figures, and in particular to FIGS. 1A and 1B, pretreatment chemicals 10, 12 according to embodiments of the present invention are shown, wherein each of R, $^1$R1, and $_2$R is an alkyl substituent or an aryl substituent. Generally, the pretreatment chemicals 10, 12 comprise an imine (e.g., a Lewis base) and an alkyl substituent or an aryl substituent and are configured to detoxify a chemical agent having at least one leaving group. A Schiff base nitrogen 14, 16 of the imine is separated from an electron acceptor (for example, acidic proton 18) by a distance, d, that ranges from about 2 bond length radii to about 10 bond length radii (that is, from about 200 pm to about 1000 pm) as determined, for example, by molecular mechanics (MM+) geometry optimization (conjugate gradient; RMS gradient 0.0001 kcal/Å·mol).

If desired, the pretreatment chemical may further comprise a cross-linking agent that is configured to form a cross-linkage chemical bond between the pretreatment chemical and a substrate.

It will be readily appreciated by the skilled artisan that the pretreatment chemical 12 illustrated in FIG. 1B is shown as a thermodynamic minimum representation, that is, as a canonical resonance form.

According to another embodiment of the present invention, a pretreatment chemical comprises a catalyst configured to react with Lewis acids, the catalyst having an electron acceptor (for example, an acidic proton) spaced away from a Schiff base nitrogen by a distance that ranges from about 200 pm to about 1000 pm (or from about 2 bond length radii to about 10 bond length radii). More specifically the catalysts are configured to react with and detoxify toxic pesticides and potent nerve agents, including, for example, phosphoric acid esters (sarin, soman, VX, diisopropyl fluorophosphates, etc.), and blister agents, (such as bis(2-chloroethyl)sulfide) having at least one leaving group. Examples of leaving groups may include, but are not limited to, one or more halide ions, thiolates, amines, alcohols, perfluoroalkylsulfonates, tosylates, and cyanide. The remaining electrophile may contain phosphorus, sulfur, arsenic, or nitrogen.

Figure 2:
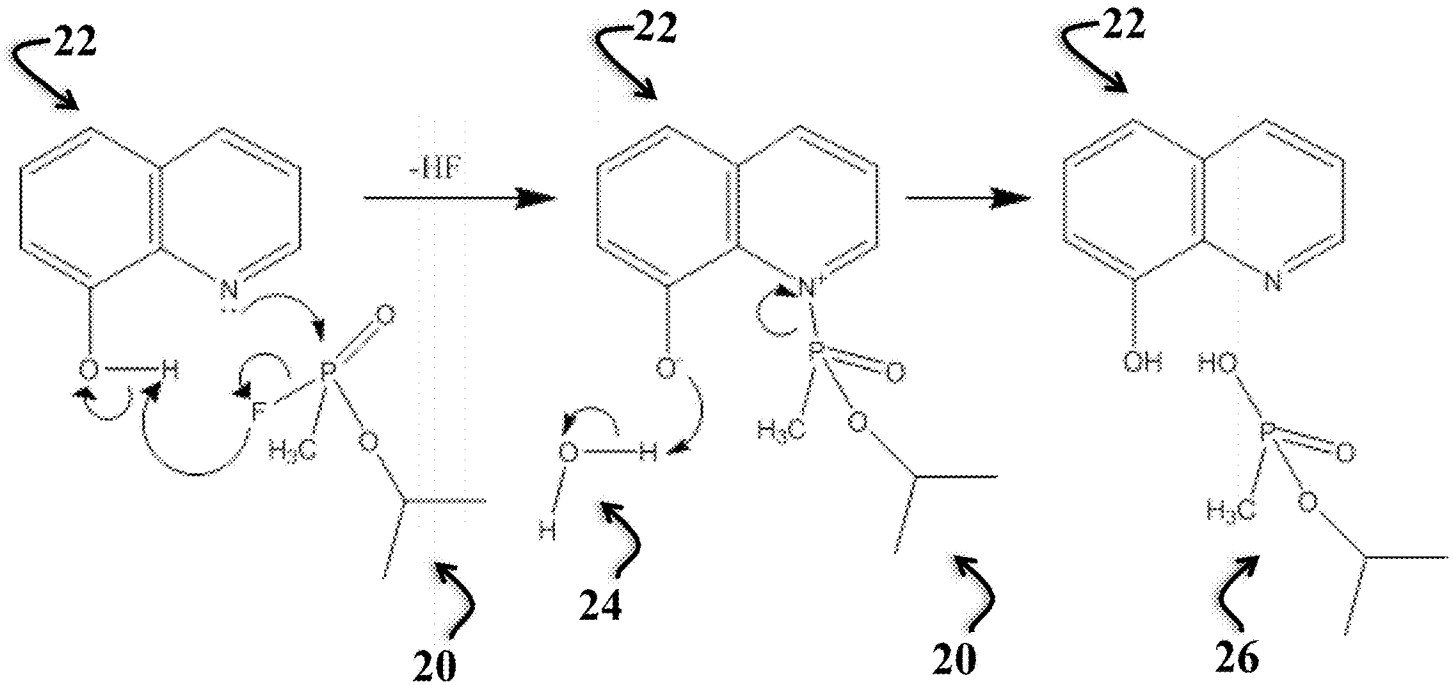
FIG. 2 is a representation of a chemical mechanism by which pretreatment chemicals according to embodiments of the present invention may neutralize sarin, a neurotoxic agent.

While not wishing to be bound by theory, it is believed that, for example, phosphoric acid esters may be decontaminated with the pretreatment chemicals of the present invention in accordance with the mechanism illustrated in FIG. 2. More particularly, FIG. 2 illustrates a reaction between sarin 20 ($[(CH_3)_2CHO]CH_3P(O)F$), an organophosophorus compound used in chemical warfare as an extremely potent nerve agent, and 8-hydroxyquinoline 22 (hereafter, "8-HQ"), a pretreatment chemical according to one embodiment of the present invention. 8-HQ 22 is a known antiseptic approved for multiple uses by the USDA. As shown, the imine group of 8-HQ 22 serves as a Lewis base that "attacks" the phosphorous center of the sarin 20 (i.e., a Lewis acid). The attack leads to a subsequent loss of HF from the system. The 8-HQ 22 activity may be regenerated by reacting with a water molecule 24, which donates a proton to the phenolate ion. 8-HQ 22 is regenerated in the presence of water by hydrolytic attack of the phosphorus atom of the 8-HQ-agent adduct, followed by release of a neutralized phosphonic acid product 26.

A similar mechanism, although not shown, is expected for an opthamolic drug, diisopropyl fluorophosphates (a cholinergic molecule), and the nerve agent, soman (O-pinacolyl methylphosphonofluoridate).

Mustard compounds, such as 2-chloroethyl ethyl sulfide and bis(2-chlorethyl)sulfide, are also expected to follow a similar mechanism. That is, a lone pair of electrons from the Schiff base nitrogen serves as the Lewis base and attacks the #2 carbon bonded to the chlorine or the a carbon bonded to sulfur in the episulfonium configuration. In concerted fashion, the chlorine picks up the local acidic hydrogen. In the presence of water, the phenolate ion from 8-HQ regains a proton from a local water molecule, and the remaining hydroxide allows regeneration of the catalyst to form from the water. Such a mechanism results in either elimination to form a vinyl product (anhydrous), or, in the presence of water, substitution to form thiodiglycol or 1,4-oxathiane, all of which are acceptably nontoxic decontamination products.

A similar mechanism is also expected for treatments against toxic industrial chemicals, such as acrolein ($CH_2CHCHO$), that is, through a catalytic reduction to 2-propen-1-ol in the presence of atmospheric water vapor.

Figure 3A:
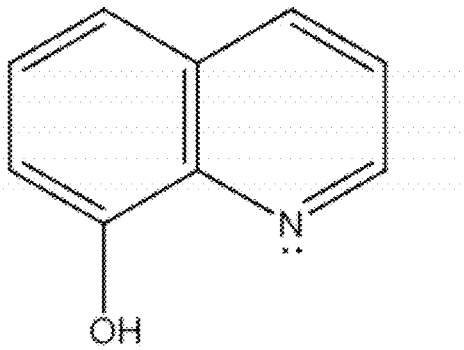
FIGS. 3A and 4A are representations of pretreatment chemicals according to other embodiments of the present invention.
Figure 4A:
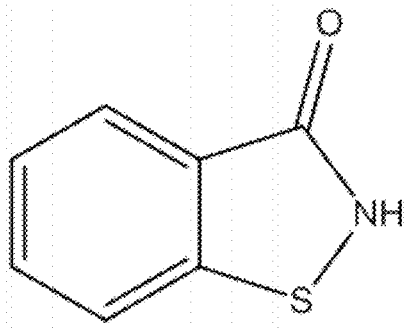

FIGS. 3A and 4A are representations of pretreatment chemicals according to still other embodiments of the present invention. Particularly, FIG. 3A is 8-HQ and FIG. 4A is 1,2-benzisothiazol-3(2H)-one (hereafter, "BIT"), which is commercially-available under the tradename BIOBAN from Dow Corning and is described in detail in U.S. Application Publication No. 2010/0125095, entitled BIOCIDAL COMPOSITION OF 2,6-DIMETHYL-M-DIOXANE-4-OL ACETATE AND METHODS OF USE, as an anti-fouling additive for coatings. BIT is approved for use in Asia and is expected to be approved for use in the US in the near future.

Figure 3B:
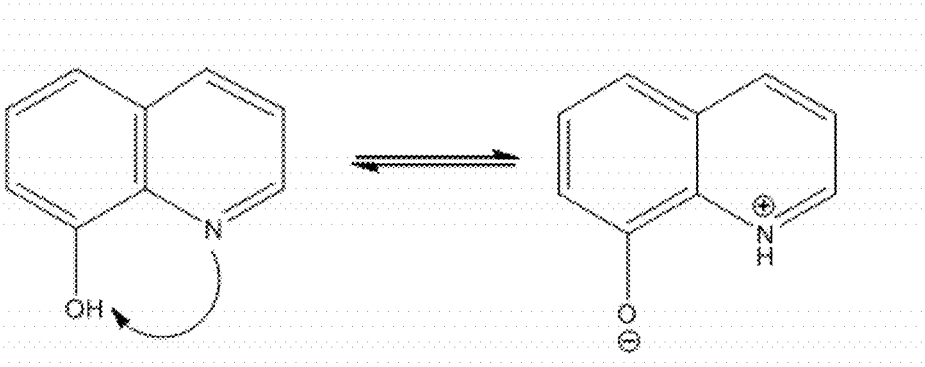
FIGS. 3B and 4B are representations of resonance tautomers of the pretreatment chemicals of FIGS. 3A and 4A, respectively.
Figure 4B:
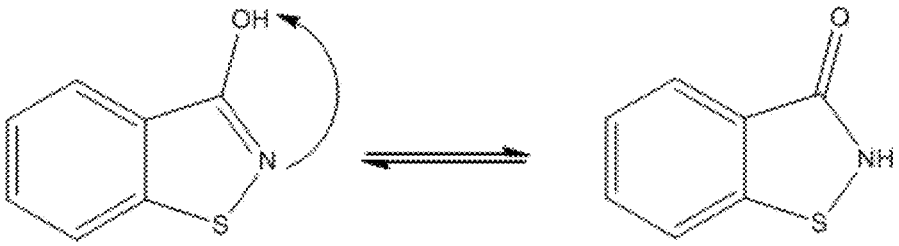

Resonance tautomers of 8-HQ and BIT are shown in FIGS. 3B and 4B, respectively.

Figure 5:
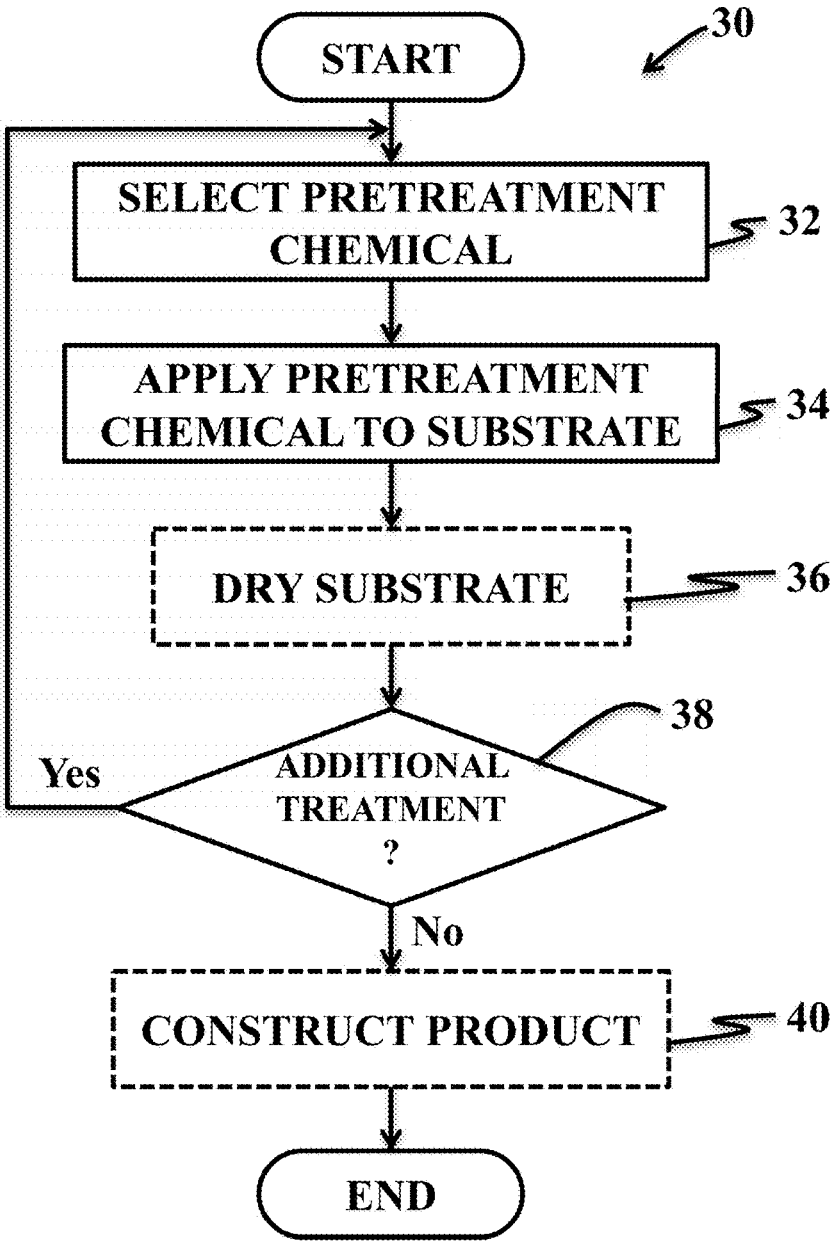
FIG. 5 is a flowchart illustrating a method of treating a substrate with a pretreatment chemical according to one embodiment of the present invention.

With reference now to FIG. 5, a flowchart 30 illustrating a method of using a pretreatment chemical according to one embodiment of the present invention is shown. In Block 32, a pretreatment chemical according to one embodiment of the present invention is selected, wherein the selection is based, at least in part, on an anticipated agent exposure. For example, the anticipated agent may be any environmental toxin, chemical warfare agent, pesticide, industrial chemical, and so forth. Section of the pretreatment chemical may also be based on the known chemical structure of the anticipated agent such that the pretreatment chemical may under an appropriate detoxification mechanism, similar to those described above.

With the pretreatment chemical selected, a quantity of the selected pretreatment is applied to a substrate (Block 34). The substrate, while referenced here as being a fabric or textile, may include any suitable coating, textile (woven and nonwovens), plastic, metal, ceramic, polymer, and so forth. Application of the pretreatment chemical may be direct, that is, without dilution, or by dissolving or suspending a quantity of the pretreatment chemical in an organic or aqueous solvent (for example, a 0.1%-30% solution) that is then applied to the substrate. In any event, the pretreatment chemical may bind to (for example, via cross-linking) or otherwise be retained by (for example, via intercalation) a material comprising the substrate. With respect to cross-linking, the pretreatment chemical may include conventional cross-linking chemistries including, for example, siloxanes, acrylates, radical polymerization, epoxides, and so forth. Generally, application of the pretreatment chemical may range from about 0.1 wt. % to about 5.0 wt. %.

If desired or necessary, the substrate may optionally be dried (Block 36). Drying may additionally or alternatively include heating, for example, in an oven (such as with exemplary temperatures ranging from about 75° C. to about 200° C.) or microwave. However, drying at temperatures above about 200° C. may damage textile fibers, melt polyolefins, or both. Cross-linking by drying may include an initiator, which may be a chemical initiator, light, or other forms of electromagnetic radiation. According to some embodiments including siloxanes, cross-linking may also occur with changes in pH.

It will be readily appreciated by those of ordinary skill in the art having the benefit of the disclosure provided herein that a plurality of pretreatment chemicals according to various embodiments of the present invention may be applied to the same substrate. In that regard, applications of pretreatment chemicals may be simultaneous or sequential. As shown in FIG. 5, and when an additional treatment is desired ("Yes" branch of Decision Block 38), then the process returns and a pretreatment chemical according to another embodiment of the present invention is selected (Block 32). Otherwise, ("No", branch of Decision Block 38), the process continues. Accordingly, resultant coatings may comprise a combination of pretreatment chemicals, such as 2.5% BIT and 2.5% 8-HQ; however, other combinations are also envisioned within the scope of this disclosure.

It would also be appreciated that the pretreatment chemical may be applied to substrate prior to or after manipulation of the substrate. For example, fabric comprising a garment may be treated prior to or after garment construction. Therefore, the treated substrate may optionally be used to construct a product, for example, a garment or headgear, or activated carbon, carbon beads, or carbon cloth (Block 40). Otherwise, although not specifically shown in FIG. 5, the substrate may be manipulated prior selection of the pretreatment chemical.

According to still other embodiments of the present invention, the substrate may be treated after exposure to an agent. In that regard, the treatment may be for purposes of remediation, demilitarization, or detoxification rather than protection or prevention.

The following examples illustrate particular properties and advantages of some of the embodiments of the present invention. Furthermore, these are examples of reduction to practice of the present invention and confirmation that the principles described in the present invention are therefore valid but should not be construed as in any way limiting the scope of the invention.

Example 1

Textile surfaces were treated with a solution comprising 1.75% w/v of 8-HQ and 1.75% BIT, or their derivatives, in 80 mL of acetone. In a separate solution, 4 mL of tetramethyl orthosilicate and 10 mL of 0.1 M hydrochloric acid are combined and vortexed for 1 min. The tetramethyl orthosilicate solution was then added to the acetone solution, mixed thoroughly, vortexed, and applied to the dry textile surface. The treated textile surface was heated until cured, such as by either conventional heating at 75° C. or microwave for 45 sec.

Example 2

Pretreatment chemicals according to embodiments of the present invention were applied to paints and coatings by replacing the pigment component of the paint or coating with a volume of the pretreatment chemical (ranging from 1% w/w to 10% w/w). The paints and coatings were applied to surfaces according to convention methods. Hazardous materials were deactivated when placed in contact with surfaces treated with the paints or coatings.

Example 3

Figure 6:
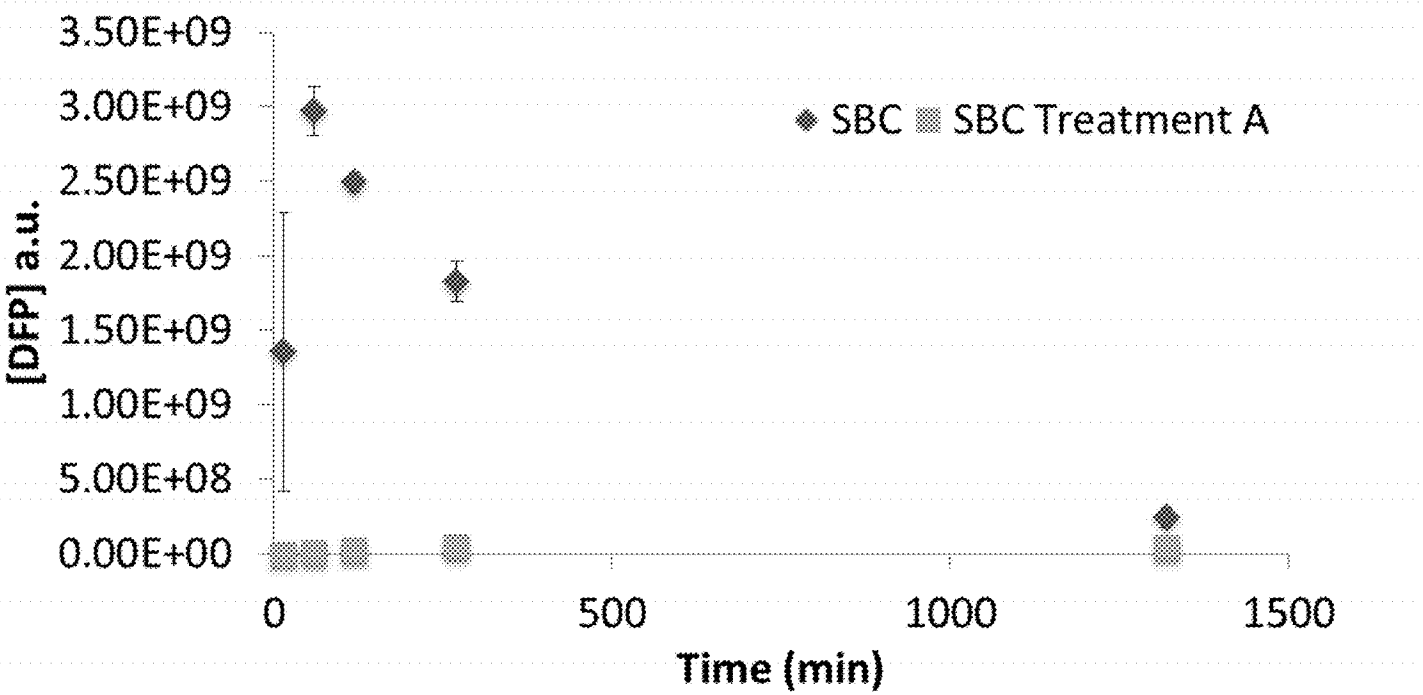
FIG. 6 is a graphical representation of data obtained from a 80 $\mu g/cm^2$ challenge of DFP vapor against cotton fabric samples treated with 8-hydroxyquinoline and 1,2-benzisothiazol-3(2H)-one.

Cotton samples treated with 8-HQ and BIT were challenged in a headspace permeation experiment against a sarin simulant, 5 μg of diisopropylfluorophosphate ("DFP") vapor, as an 80 $\mu g/cm^2$ total challenge. In FIG. 6, "SBC Treatment A" is shown to outperform the SBC control, particularly over the first several hours.

Table 1, below, provides specific data values shown in FIG. 6. At 15 min, the treated cotton samples offer full vapor protection from DFP. After 60 min, the treatment reduces the contaminant breakthrough by roughly 2.5-log, and at 120 min the treatment still mitigates the challenge by about two-orders of magnitude.

TABLE 1

| Time (min) | 15 | 60 | 120 | 270 | 1320 |
|---|---|---|---|---|---|
| SBC | 1.35E+09 | 2.97E+09 | 2.49E+09 | 1.83E+09 | 2.42E+08 |
| σ (+/−) | 9.32E+08 | 1.65E+08 | 6.56E+07 | 1.36E+08 | 6.52E+07 |
| SBC Treatment A | 0.00E+00 | 6.46E+06 | 2.09E+07 | 4.39E+07 | 3.45E+07 |
| σ (+/−) | 0.00E+00 | 1.59E+06 | 4.98E+06 | 1.12E+07 | 8.00E+06 |

Example 4

Figure 7:
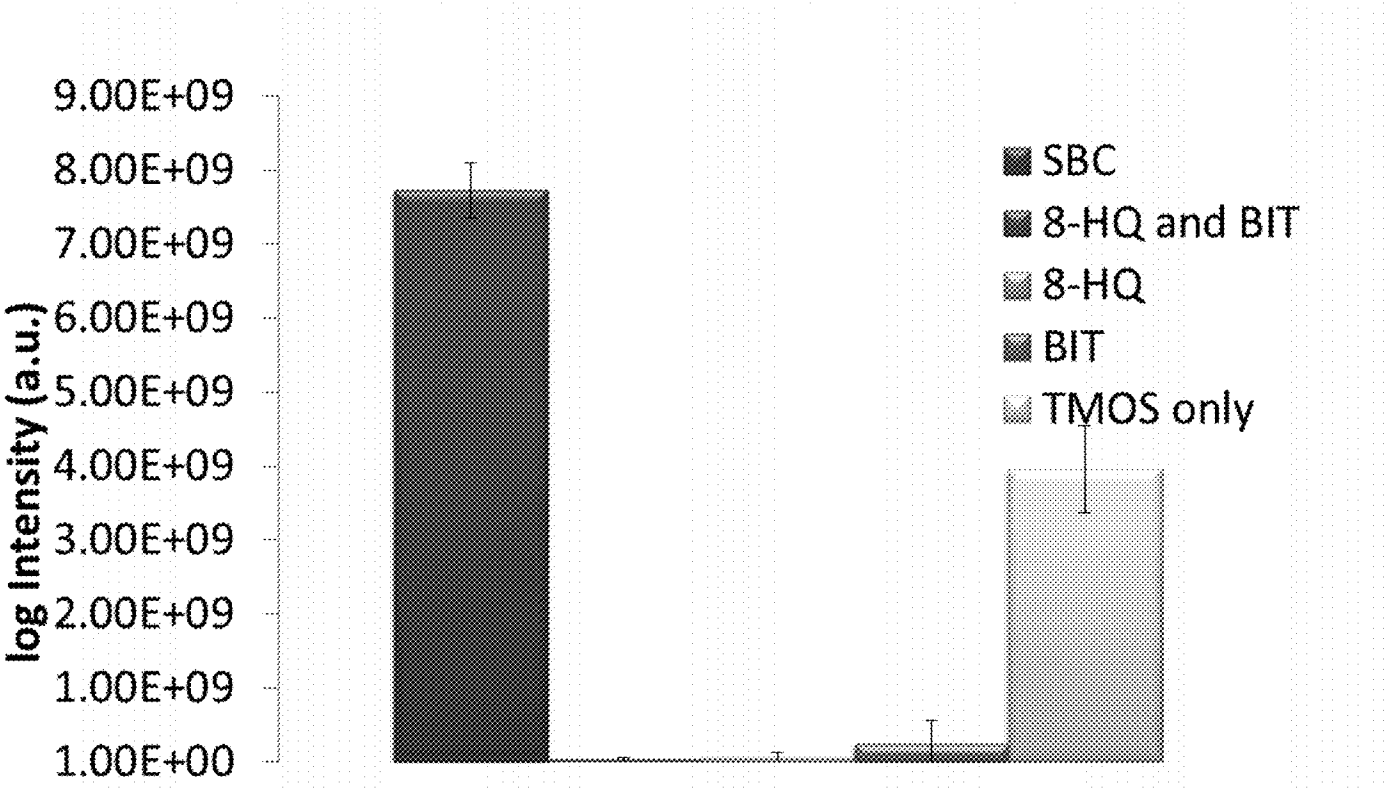
FIG. 7 is a graphical representation of DFP performance against control samples and cotton fabric samples treated with 8-hydroxyquinoline and 1,2-benzisothiazol-3(2M-one.

Cotton samples were treated with different combinations of 8-HQ/BIT and challenged for 2 hr with 5 μg DFP vapor in a headspace permeation experiment. In FIG. 7, all combinations of 8-HQ/BIT are shown to mitigate the DFP challenge with respect to the controls. Tetramethyl orthosilicate ("TMOS"), used herein as a cross-linker to attach catalysts to the cotton samples, was also included as a negative control.

Example 5

Figure 8:
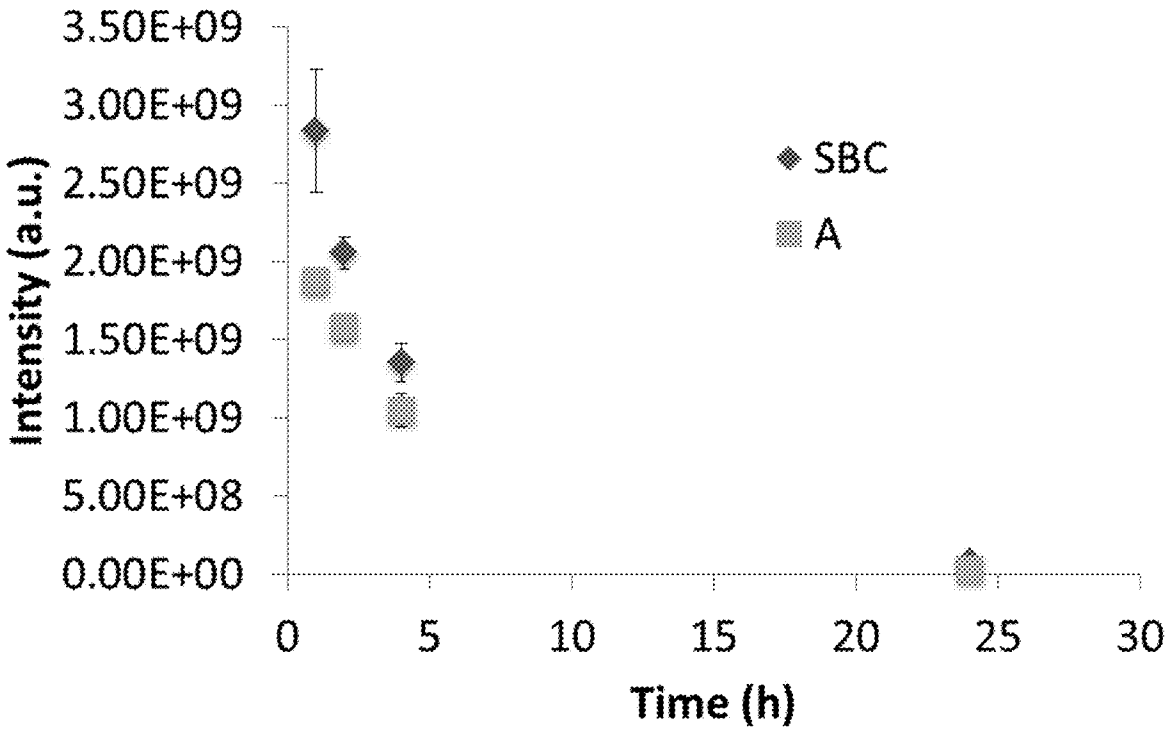
FIG. 8 is a graphical representation of an 80 μg/cm$^2$ challenge of DFP vapor against cotton fabric samples treated with 8-hydroxyquinoline and 1,2-benzisothiazol-3(2H)-one.

FIG. 8 is a graphical representation of the same 8-HQ/BIT combination material as Example 4 but against sulfur mustard, bis(2-chloroethyl) sulfide ("HD"). Table 2, below, provides specific data values from FIG. 8. While these results are not as dramatic as those demonstrated with DFP in FIG. 7, there was still a 25% to 92% reduction of the mustard challenge at different points during a 24 hr span.

TABLE 2

| Time (min) | 60 | 120 | 270 | 1410 |
|---|---|---|---|---|
| SBC | 2.83E+09 | 2.05E+09 | 1.35E+09 | 8.13E+07 |
| SBC Treatment A | 1.88E+09 | 1.58E+09 | 1.05E+09 | 3.02E+07 |
| % diff [HD] | 40 | 26 | 25 | 92 |

Example 6

Figure 9:
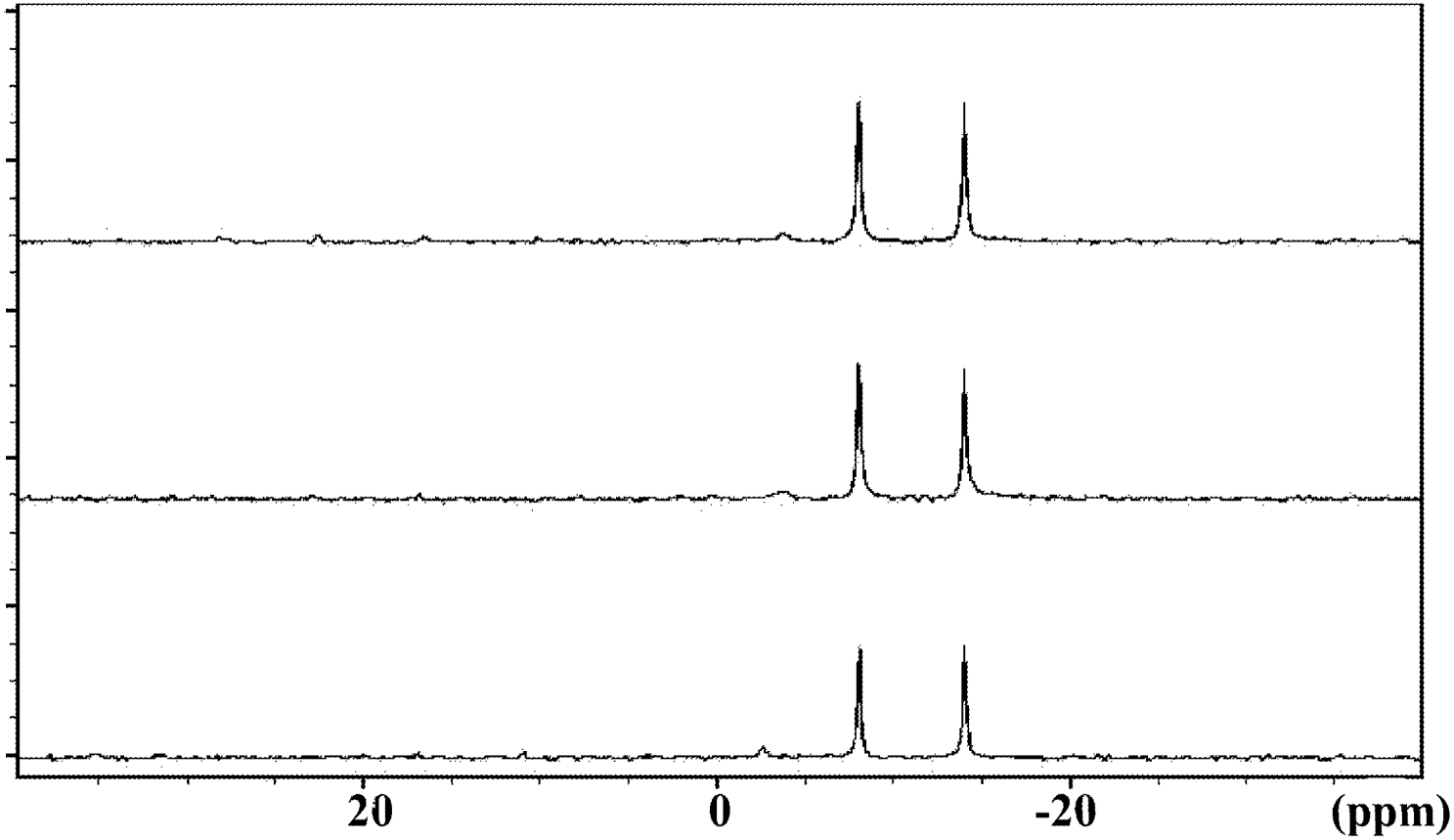
FIG. 9 illustrates three $^{31}$P NMR spectra of a challenge of DFP vapor against cotton fabric samples treated with pretreatment chemicals according to embodiments of the present invention.

FIG. 9 includes $^{31}$P NMR data, obtained from the U.S. Army Natick Soldier Research Development & Engineering Center (Natick, Mass.) for the decomposition of DFP in the presence of the three different pretreatment chemical formulations according to embodiments of the present invention (shown below in Table 3). The presence of the phosphonic acid decomposition product 26 (FIG. 2) at −3 ppm (FIG. 9) is clearly visible, particularly in the third sample, C, containing 2.5% 8-HQ and BIT, after about 10 min of exposure. The differences in chemical shift are thought to occur by perturbation of the magnetic field due to the incorporation of SiNPs.

TABLE 3

| Fabric | Composition |
|---|---|
| A | 2.5% 8-HQ |
| B | 2.5% 8-HQ and Fluorinated Silane |
| C | 2.5% 8-HQ, BIT, SiNP, and Fluorinated Silane |

Example 7

8-HQ treated fabric and controls were tested against a 400 μg/cm$^2$ sample of soman for 5 days. Permeation data, acquired at the Army Edgewood Chemical and Biological Center (Edgewood, Md.), are shown in Table 4, below. Treated fabrics outperformed the controls against the soman agent by approximately 100-fold, which was observable for up to 5 days (arbitrary units).

TABLE 4

| Time (days) | Control Sample 1 | Control Sample 2 | 8-HQ Sample 1 | 8-HQ Sample 2 | 8-HQ Sample 3 | Average (8-HQ/ Control) |
|---|---|---|---|---|---|---|
| 1 | 7.7 | 5.4 | ND | ND | ND | N/A |
| 5 | 42.6 | 35.4 | 0.6 | 0.37 | 0.34 | 1.12% |

Table 5 includes data, similar to Table 4, but against a 400 μg/cm$^2$ sample of sulfur mustard agent for 3 days. Treated fabrics outperformed the controls against the sulfur mustard agent by approximately 10-fold, which was observed for up to 3 days (arbitrary units).

TABLE 5

| Time (hr) | Control Sample 1 | Control Sample 2 | 8-HQ Sample 1 | 8-HQ Sample 2 | 8-HQ Sample 3 | Average (8-HQ/ Control) |
|---|---|---|---|---|---|---|
| 8 | 152.4 | 155.5 | 18.4 | 15.6 | 16.1 | 10.7% |
| 72 | 27.86 | 39.02 | 0.97 | 0.74 | 0.96 | 2.6% |

Table 6 includes data, similar to Tables 4 and 5, but against a 400 μg/cm$^2$ sample of DFP for 2 days. Treated fabrics outperformed the controls against the DFP agent by approximately 10-20-fold, which was observed for up to 2 days (arbitrary units).

TABLE 6

| Time (h) | Control Sample 1 | Control Sample 2 | 8-HQ Sample 1 | 8-HQ Sample 2 | 8-HQ Sample 3 | Average (8-HQ/ Control) |
|---|---|---|---|---|---|---|
| 8 | 190.9 | 157.5 | 19.1 | 15.6 | 24.8 | 11.3% |
| 24 | 244.2 | 256.8 | 14.22 | 12.6 | 16.1 | 5.6% |
| 48 | 185.2 | 245.1 | 2.8 | 2.8 | 3.8 | 1.4% |

Table 7 summarized direct liquid deposition testing on the fabrics tested in this Example 7. Treated fabrics performed significantly better than controls against all three agents (arbitrary units).

TABLE 7

| Agent | Control | 8-HQ Sample 1 | 8-HQ Sample 2 | Average (8-HQ/Control) |
|---|---|---|---|---|
| Soman | 469.2 | 0.94 | 0.4 | 0.14% |
| Sulfur Mustard | 4164 | 54.3 | 76.4 | 1.57% |
| DFP | 1543 | 11.9 | 8.3 | 0.65% |

While the present invention has been illustrated by a description of one or more embodiments thereof and while these embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the scope of the general inventive concept.

What is claimed is:

1. A composition for detoxification of a toxic chemical agent having at least one leaving group, the composition comprising:

8-hydroxyquinoline or 1,2-benzisothiazol-3(2H)-one; and a cross-linking agent configured to chemically bind 8-hydroxyquinoline or 1,2-benzisothiazol-3(2H)-one to a substrate, wherein the cross-linking agent is a siloxane, an acrylate, an epoxide, or a combination thereof.

2. The composition of claim 1, wherein the leaving group of the toxic chemical agent includes one or more halide ions, a thiolate, an amine, an alcohol, a perfluoroalkylsulfonate, a tosylate, cyanide, or combinations thereof, and a remaining electrophile includes a phosphorus, a sulfur, an arsenic, or a nitrogen.

3. A method of preparing a detoxifying substrate, the method comprising:

selecting a first composition according to claim 1 and according to a first expected toxic chemical agent exposure;

applying a quantity of the first selected composition to the substrate; and optionally drying the substrate.

4. The method of claim 3, further comprising:

selecting a second composition according to claim 1 and according to a second expected chemical agent exposure;

applying a quantity of the second selected composition to the substrate; and optionally drying the substrate.

5. The method of claim 4, wherein a combined quantity of the first and second compositions does not exceed 20 wt. %.

6. The method of claim 3, wherein drying the substrate includes applying an electromagnetic radiation, applying irradiative heat, changing pH, or combinations thereof.

7. A method of detoxifying a contaminated substrate, the method comprising:

selecting a composition according to claim 1 and according to the contamination of the substrate; and applying a quantity of the selected compound to the contaminated substrate.

8. The method of claim 7, further comprising:

drying the substrate after applying the quantity of the selected composition.

* * * * *